US011013977B2

(12) United States Patent
Santino, Jr.

(10) Patent No.: US 11,013,977 B2
(45) Date of Patent: May 25, 2021

(54) SYSTEM AND METHOD FOR ATHLETIC COMPETITION SIGNALING

(71) Applicant: Nicholas A. Santino, Jr., Newark, NY (US)

(72) Inventor: Nicholas A Santino, Jr., Newark, NY (US)

( * ) Notice: Subject to any disclaimer, the term of this patent is extended or adjusted under 35 U.S.C. 154(b) by 550 days.

(21) Appl. No.: 14/924,312

(22) Filed: Oct. 27, 2015

(65) Prior Publication Data

US 2016/0114238 A1 Apr. 28, 2016

Related U.S. Application Data

(60) Provisional application No. 62/068,892, filed on Oct. 27, 2014, provisional application No. 62/204,483, filed on Aug. 13, 2015.

(51) Int. Cl.

| | |
|---|---|
| ***A63B 71/00*** | (2006.01) |
| ***G08B 5/38*** | (2006.01) |
| ***A63K 3/00*** | (2006.01) |
| ***A63B 71/06*** | (2006.01) |
| ***A63B 5/10*** | (2006.01) |
| ***A63K 3/02*** | (2006.01) |

(52) U.S. Cl.

CPC ..... *A63B 71/0009* (2013.01); *A63B 5/10* (2013.01); *A63B 71/0622* (2013.01); *A63K 3/00* (2013.01); *A63K 3/023* (2013.01); *G08B 5/38* (2013.01); *A63B 2209/10* (2013.01); *A63B 2225/09* (2013.01); *A63B 2225/50* (2013.01); *A63B 2225/74* (2020.08); *A63B 2244/20* (2013.01)

(58) Field of Classification Search

CPC ..... G08B 5/38; A63B 71/009; A63B 71/0622; A63B 5/10; A63B 2225/74

USPC ..... 340/4.13

See application file for complete search history.

(56) References Cited

U.S. PATENT DOCUMENTS

| | | | |
|---|---|---|---|
| 3,665,452 | A | 5/1972 | MacCreadie |
| 3,678,496 | A | 7/1972 | Stalp |
| 3,916,214 | A | 10/1975 | Coble, Jr. et al. |
| 3,944,763 | A | 3/1976 | Beierwaltes |
| 3,955,076 | A | 5/1976 | Shaw |
| D240,220 | S | 6/1976 | Meyer |
| D240,811 | S | 8/1976 | Beall, Jr. |
| 4,117,283 | A | 9/1978 | Hurzeller et al. |
| 4,137,586 | A | 1/1979 | Davidson |

(Continued)

FOREIGN PATENT DOCUMENTS

JP 02000039518 * 2/2000

OTHER PUBLICATIONS

"SwimSight: Supporting Deaf Users to Participate in Swimming Games", OzCHI '16, Nov. 29-Dec. 2, 2016, Launceston, TAS, Australia © 2016 ACM (http://dl.acm.org/citation.cfm?doid=3010915.3010969).

(Continued)

*Primary Examiner* — Vernal U Brown

(74) *Attorney, Agent, or Firm* — Duane C. Basch; Basch & Nickerson LLP

(57) ABSTRACT

In a competitive athletic event the disclosed signaling system provides for visually signaling of participants, for example, a lane specific visible indication to begin a race. A sequence of light colors is used to signal the start of a race, and is believed advantageous over an audible start signal, particularly for athletes who are hearing impaired.

20 Claims, 7 Drawing Sheets

(56) References Cited

U.S. PATENT DOCUMENTS

| | | | | |
|---|---|---|---|---|
| 4,194,101 | A | 3/1980 | Berseth | |
| 4,475,016 | A | 10/1984 | Berger | |
| 4,780,085 | A * | 10/1988 | Malone | A63B 71/06 340/323 R |
| 4,935,733 | A | 6/1990 | Munekata | |
| 5,349,549 | A | 9/1994 | Tanaka | |
| 5,920,921 | A | 7/1999 | Poole | |
| 5,977,493 | A | 11/1999 | Tanaka | |
| 6,181,236 | B1 * | 1/2001 | Schneider, Jr. | G08B 1/08 340/323 R |
| 6,211,626 | B1 * | 4/2001 | Lys | A61N 5/0616 315/291 |
| D464,699 | S | 10/2002 | Brice | |
| 6,523,188 | B1 | 2/2003 | Kiefer et al. | |
| 7,193,167 | B1 | 3/2007 | Brice | |
| RE42,339 | E | 5/2011 | Brice | |
| 2003/0006903 | A1 * | 1/2003 | Naegely | G08B 1/08 340/4.12 |
| 2003/0076281 | A1 * | 4/2003 | Morgan | F24C 7/004 345/44 |
| 2004/0233059 | A1 * | 11/2004 | Smith | A01K 15/021 340/573.3 |
| 2010/0165655 | A1 * | 7/2010 | Alcov | F21S 9/026 362/551 |

OTHER PUBLICATIONS

"Quickblox Establish New Starting Block Technology," Swimming World Magazine, http://www.swimmingworldmagazine.com/news/quikblox-establish-new-starting-block-technology/; Sports Publications, Inc. ; Apr. 10, 2000, (4 pages).

D. Matchett, "Universal Design Starting System presentation", Oct. 25, 2011.

M. Titus et al., "USDS 2012 Universal Starting System 19APR", Apr. 20, 2012.

* cited by examiner

SYSTEM AND METHOD FOR ATHLETIC COMPETITION SIGNALING

This application claims priority under 35 U.S.C. § 119(e) from U.S. Provisional Patent Application No. 62/204,483 for a SYSTEM AND METHOD FOR ATHLETIC COMPETITION SIGNALING, filed Aug. 13, 2015 by Nicholas A. Santino, Jr., and from U.S. Provisional Patent Application No. 62/068,892 for a SYSTEM AND METHOD FOR ATHLETIC COMPETITION SIGNALING, filed Oct. 27, 2014 by Nicholas A. Santino, Jr., both US Provisional applications being hereby incorporated by reference in their entirety.

BACKGROUND & SUMMARY

The disclosed embodiments relate to a signaling device and system for an athletic competition and, more particularly, to an electronic starting device that includes signaling devices with lights to permit accurate starting and timing of races and other competitive events and games that include hearing impaired athletes. Traditionally a centralized combination sound and light system is used to initiate the start of a race, wherein a sound is produced either from a starting whistle, pistol or through an electronic loud-speaker in the proximity to the start line. A flash of light often accompanies the sound so the contestants, as well as the officials, are made fully aware of the signal to begin the competition. The equivalent in outdoor track and field competition is a starter's pistol that emits both a sound and a puff of smoke in response to the starter pulling the trigger of the pistol. Although sound generating devices for starting races have long been used, recently they have met objections in that proper placement of the sound source to permit equitable reception of audible signals by all contestants has been difficult to obtain. Furthermore, while hearing impaired athletes and competitors may be disadvantaged by their inability to easily perceive sound, the disclosed embodiments provide a visual cue and an equitable starting method for all athletes. And, the use of a signaling system employing lights may improve the responsiveness and accuracy for hand-timed events as well.

Often races are decided by milliseconds; therefore, the seemingly minimal delay between the start and the times the various athletes receive the audible start signal has become increasingly important in sporting events. Therefore, a visual starting cue, in the proximity of the competitor, has become preferable. Additionally, hearing impaired athletes are becoming more involved in competitive sports, most notably in swimming events. Lacking an individual visual cue the hearing impaired swimmer must either use peripheral vision to react to a flash of light near the starter, or in the alternative look up and observe the starter's hand signals, either of which potentially compromises the hearing impaired swimmer's body position at the start. Consequently, in the interest of equality, it is imperative that an electronic starting system include at least a visual cue for the participants.

In the Swimmers Official's Guidelines Manual (July 2012), hereby incorporated by reference, on page 26 under *Modifications for the deaf and hard-of-hearing*, the guide states "Deaf and hard of hearing swimmers require a visual starting signal, i.e., a strobe light and/or starter's arm signals. The modification may include the referee reassigning lanes within the swimmer's heat, i.e., exchanging one lane for another, so that the strobe light or starter's arm signal can more clearly be seen by the deaf or hard-of-hearing swimmer." Given the prerequisite that accommodations for special needs should be as transparent as possible, the interchanging of lanes, visual hand signals and providing a strobe light has been acknowledged as exceedingly intrusive in a hybrid event, and in some cases ineffective. For instance, the preparatory start protocol for any individual competition advises the athlete to first approach the blocks, take their mark and then go, as stated in the Swimmers Official's' Guidelines Manual (p. 8). Furthermore a central strobe light is not necessarily applicable to the referee's announcements of the event as stated in the SOGM on page 9;

"Suggested protocol for forward start whistle preparatory commands when there is only one official (referee/starter):

- to bring the swimmers to the starting area, the referee/starter blows a short series of whistles (no fewer than 4) followed by the announcer or referee/starter announcing the event/distance/heat, e.g., "This is the 200-yard freestyle, heat 2,"
- when all swimmers have approached the blocks, the referee/starter blows a long whistle for the swimmers to step onto the blocks and take their positions,
- when swimmers are settled into position, give the command, "Take your mark,"
- when swimmers are stationary, activate the starting signal.

Note: If a swimmer(s) has not responded to the whistle indicating they should step up or step in, the referee/starter should give the verbal commands."

It is further noted, in particular, that in conventional swimming events a visual queue must be able to be seen from either a standing position (e.g., on the starting platform), or from an alternate position (e.g., in the water during backstroke events). For example, U.S. Pat. No. 7,193,167 discloses a single start light integrated within a complete starting platform for the purpose of visually alerting an athlete to the start of a race, similar to the aforementioned strobe light as discussed above. The limitation of a solitary start light is that a competitive athlete traditionally relies on a starting sequence including a "step-up" and a "take your mark" indication to psychologically and physiologically prepare for the start of a race.

In accordance with a feature of the disclosed embodiment, providing a sequence of visual indicators at the start of a competitive race significantly "levels the playing field" so that each athlete has an equal reaction opportunity, regardless of any hearing deficiency. Practically speaking, however, given that existing competitive swimming pools already include a starting platform for each lane, it would be cost prohibitive to replace the existing platforms with new platforms.

Therefore it is desirable to provide a signaling system that is modularized and/or self-supporting such that it can be used with various styles of starting platforms or in different athletic event venues (e.g., swimming pools, indoor and outdoor tracks, volleyball and basketball courts, soccer fields, etc.). Moreover, the disclosed embodiments provide a plurality of signaling colors in order to improve the capability for the system to indicate different starting commands. For example, providing at least three signaling elements (e.g., flashing red for ready, solid blue for take your mark, solid green for go) to produce a visual output viewable from a plurality of positions about the start platform.

As further disclosed in alternative embodiments, the signaling system is suitable for use in various configurations, permitting an adaptable configuration that can be used with different starting platforms as well as different venues.

For example, each and every starting platform could include a detachable base and illuminating elements electrically connected to a common controller.

Additionally, it is contemplated that a single controller would independently energize the signaling elements in a defined sequence, where a controller (wired or wireless) selectively operates at least one of the signaling elements simultaneously.

Furthermore, each one of the three or more light emitting components could include a unique color, or for color blind athletes a flashing pattern or other nomenclature indicative of the light's significance.

Disclosed in embodiments herein is an athletic competition (e.g., swimming) signaling apparatus, comprising: a translucent housing, said housing including an attachment component coupling the housing to a structure, and at least three independent signaling elements operatively associated with said housing; wherein a first of the at least three signaling elements produces a visual output viewable from a plurality of positions including both a starting position and a staging position, and where the remaining two of the at least three signaling elements are viewable from primarily from the starting position.

Also disclosed herein is an athletic competition signaling apparatus, comprising: a base resting on a surface adjacent the starting position of an athletic competition, said base including a battery compartment therein for holding a battery, and an attachment component extending from said base; a rod, adjustably attached to said attachment component; a translucent light housing, said light housing including a linear tape with a plurality of light emitting diodes of at least two different and individually activated colors sequentially spaced along the linear tape, said linear tape wrapped about a core and inserted within a translucent hollow tube, said tube also including at least one end cap for receiving the core with wrapped tape therein, and a second attachment component coupling the housing to a support structure such as the rod; and control circuitry, operatively connected to said battery and the signaling elements, said circuitry controlling, in response to a plurality of external signals, the on/off state for the signaling elements; wherein a first of the at least three signaling elements produces a visual output viewable from a plurality of positions including both a starting position and a staging position, and where the remaining two of the at least three signaling elements are viewable from primarily from the starting position.

Figure 1:
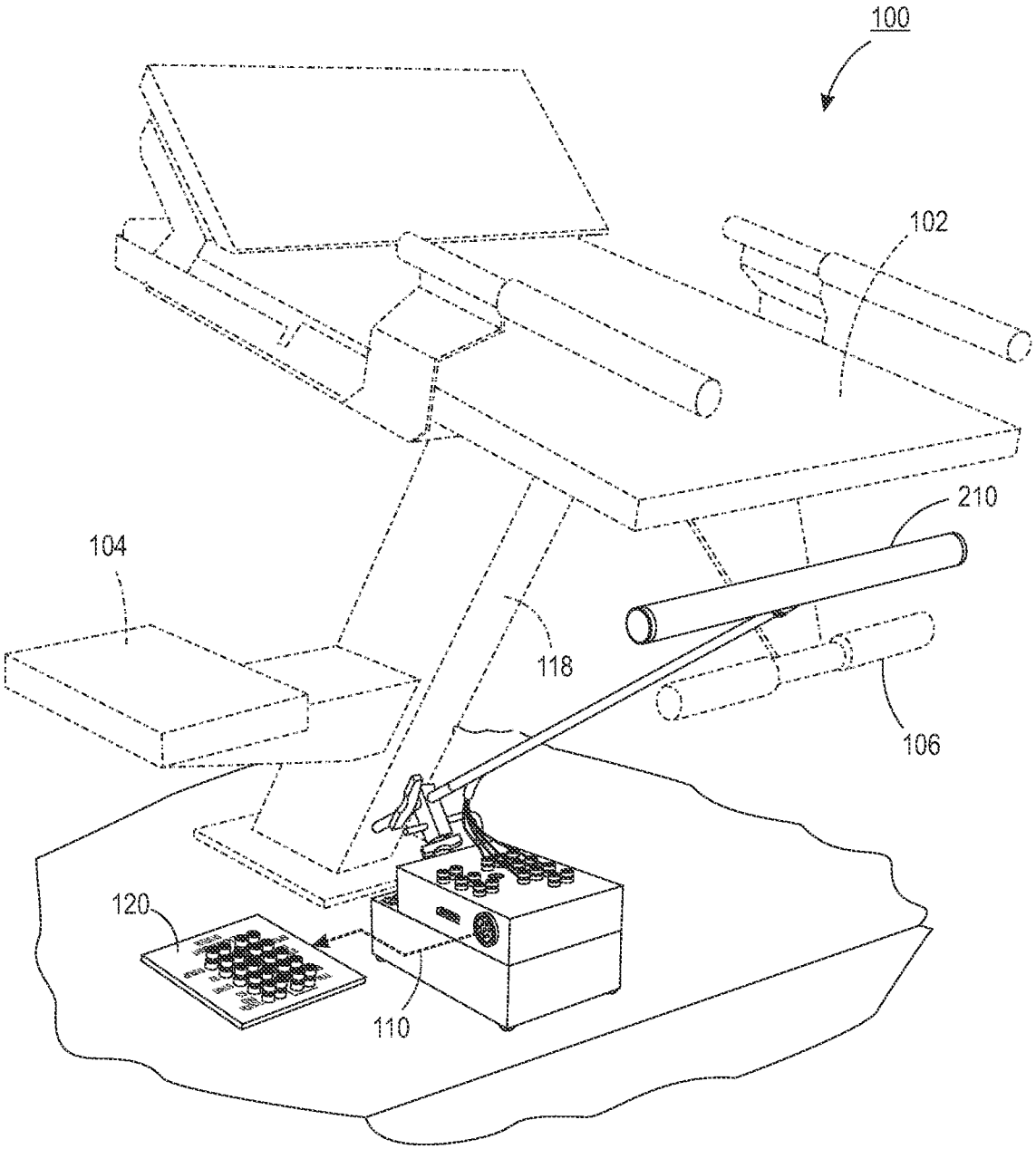
FIG. 1 is a view of an exemplary starting platform for a swimming event with an associated signaling device.

The various embodiments described herein are not intended to limit the disclosure to those embodiments described. On the contrary, the intent is to cover all alternatives, modifications, and equivalents as may be included within the spirit and scope of the various embodiments and equivalents set forth. For a general understanding, reference is made to the drawings. In the drawings, like references have been used throughout to designate identical or similar elements. It is also noted that the drawings may not have been drawn to scale and that certain regions may have been purposely drawn disproportionately so that the features and aspects could be properly depicted.

DETAILED DESCRIPTION

For a general understanding, reference is made to the drawings. In the drawings, like references have been used throughout to designate identical or equivalent elements. It is also noted that the drawings may not have been drawn to scale and that certain regions may have been purposely drawn disproportionately so that the features and concepts could be properly illustrated.

Referring to FIG. 1 illustrated is a conventional swim platform 100 having platform surface 102 for a swimmer to stand upon from step 104. The platform surface 102 of the competitive starting system is situated on and mounted to the pool deck adjacent to a swimming lane. Foot step 104 is oriented to provide access to surface 102 for the get ready position. A rearward facing bar or handle(s) 106 is positioned either vertically or horizontally beneath the platform so a swimmer is able to grasp bar 106 from within the pool for the ready position of a backstroke event. Platform surface 102 further includes at least one support member 118, which is inserted into or attached to a corresponding mounting feature within the apron or deck of the pool.

In one embodiment a deck plate 120 may be located in direct proximity of support member 118 to provide connectivity between one or more signaling devices and a central power source and/or controller via a cable or wiring harness 110 to a central connection unit or alternatively a wireless controller to provide a user control device operable by a race official. Alternatively, in the absence of installed deck plates a cable or wiring harness interface may be used between each signaling device. While various forms of interconnection may be used, conventional color-coded banana-type plugs and jacks are illustrated in several embodiments. Such plugs are available from many sources, including Pomona Electronics (e.g., single solderless stackup banana plugs Model 1325, and double plugs with wire guide Model MDP).

Figure 2:
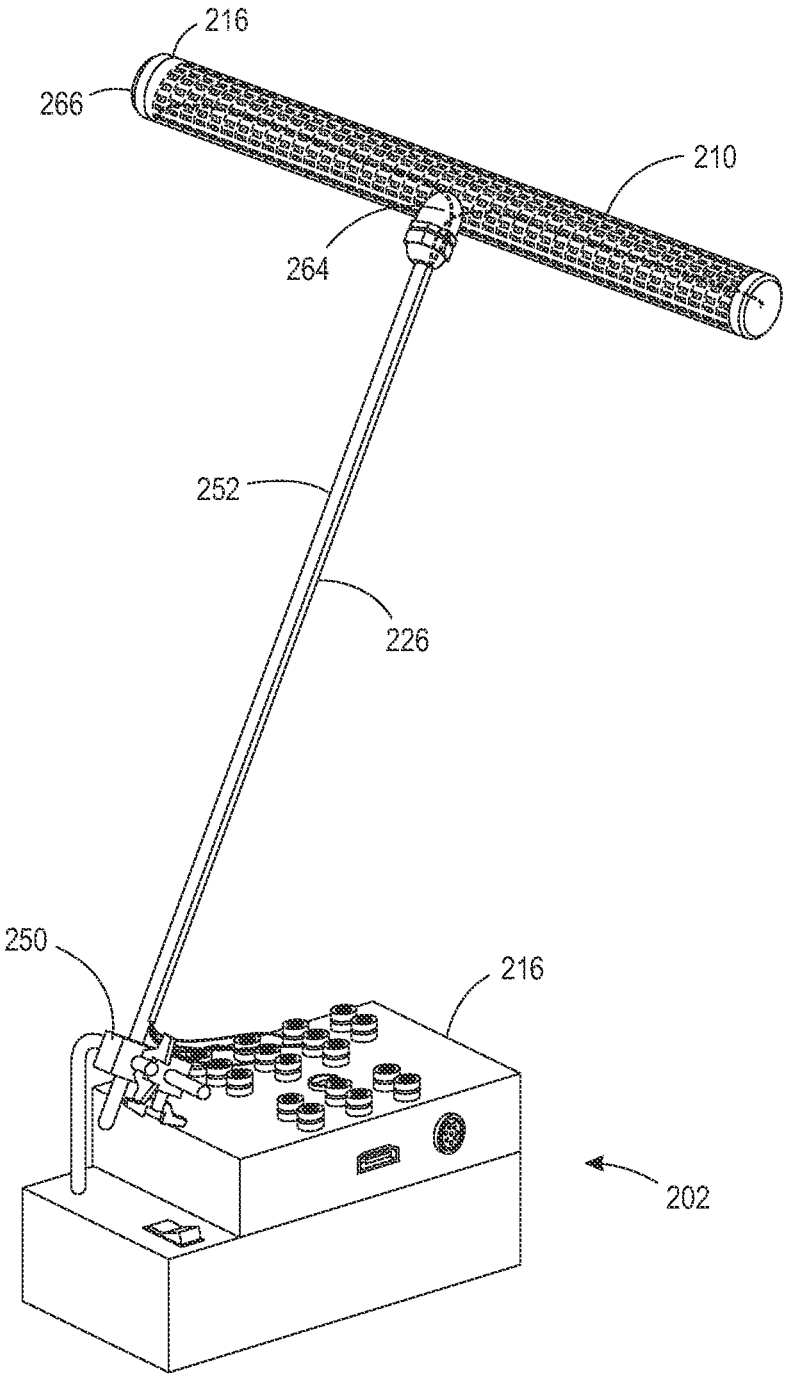
FIG. 2 is a perspective view of an embodiment of the signaling device.

In one embodiment deck plate 120 may include connectors for both conventional timing system signals, as well as the power and signal connections for the signaling components disclosed herein. Deck plate 120 is a multi-layer plastic that is engraveable (Rowmark® HW-853 series) and provides connection for the signaling light system that may be mounted on or associated with swimmer platform 100. In one embodiment, for example as depicted in FIG. 2, the signaling system includes an approximately 16-inch long and generally round translucent tube that forms an outer shell of the light housing. For example, the tube may be an extruded polycarbonate material that is rendered translucent during its manufacture of via a post-manufacturing treatment or coating applied to its interior. While shown in a stand-alone configuration in FIG. 2, the signaling system is adaptable such that the light housing position may be adjusted or it may be removed or detached from the base so that the light housing is easily connected to and removed from the start blocks. The connections and adjustments are made using attachment components such as block 250 and a rod 252 to fit just under the platform. In a swimming venue, housing 216, or at least light tube 210, is attachable adjacent or on platform structure 102 and/or support member 118 by any suitable means, such as a spring clip, adjustable clamp, Velcro®, adhesive or various connection hardware such as nuts and bolts. The ability to retrofit the disclosed signaling light system into existing swim platforms provides several advantages: (i) only placed on platform during competition events; (ii) portable, can be moved between pools or other event venues; (iii) readily adapts a pool or existing venue to accommodate events that include hearing impaired athletes; and (iv) cost effective by avoiding replacement of existing starting platforms.

Figure 8:
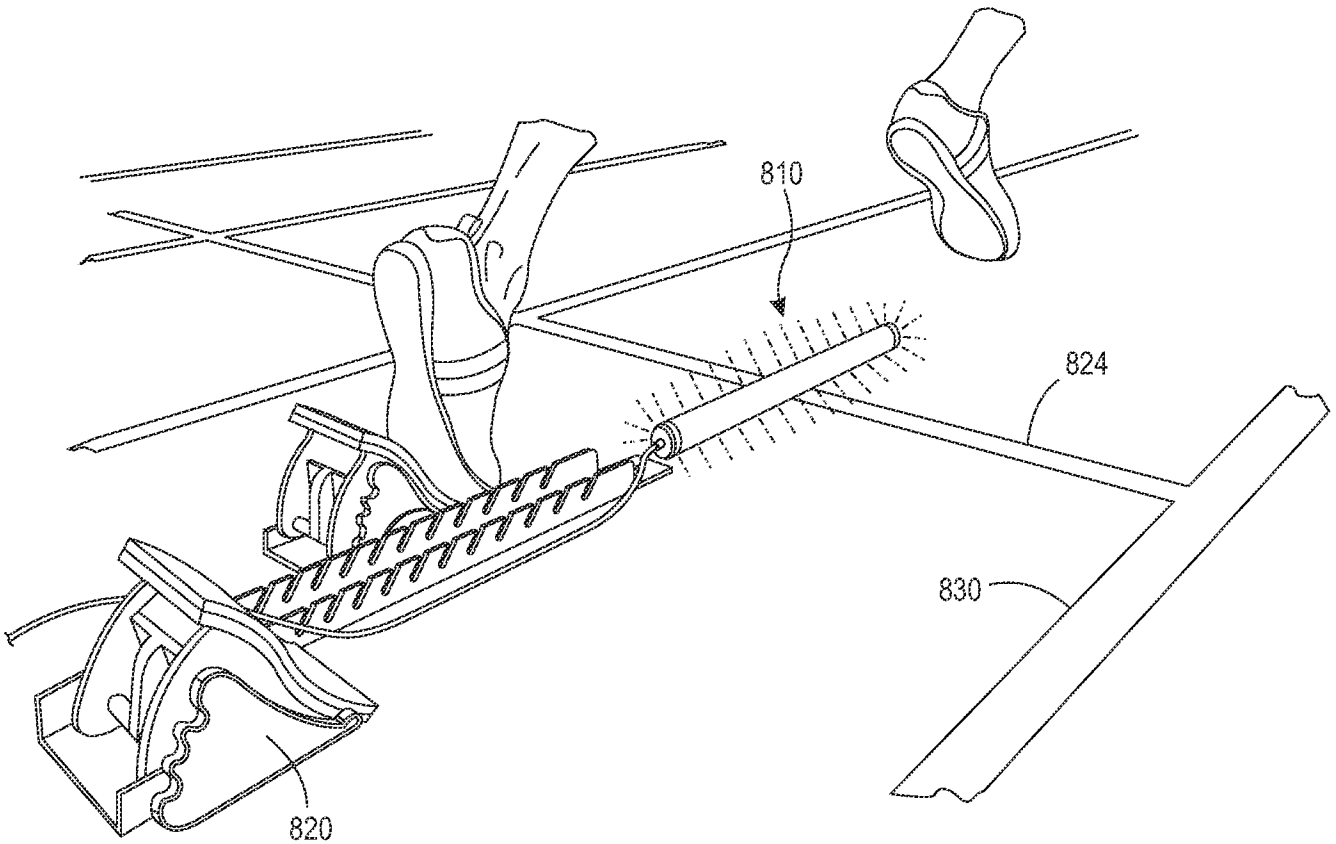
FIG. 8 is an illustrative example showing the use of the signaling device in accordance with a track and field venue as an alternative embodiment . . . .

In other sporting venues the light housing may simply rest on the ground (e.g., FIG. 8), or may be supported in a desired (e.g., vertical or horizontal) position from a weighted base or a multi-leg stand.

Figure 4:
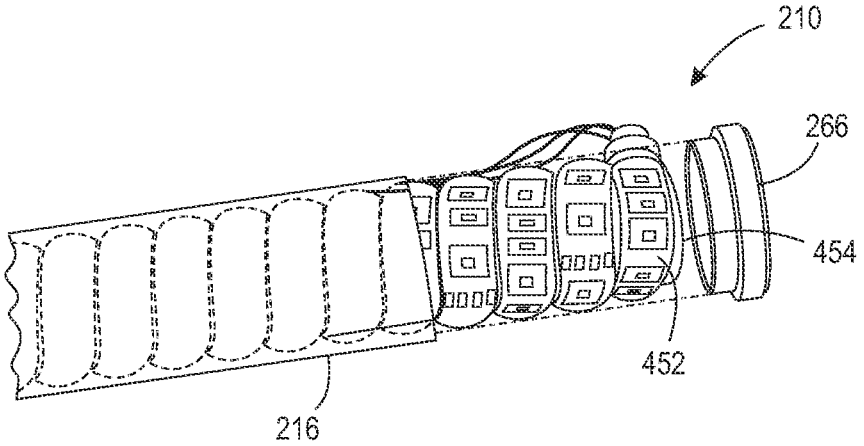
FIG. 4 is a representation of the components in a translucent light housing used as part of the signaling device.

More specifically, as illustrated in the embodiment of FIG. 2, the signaling apparatus comprises translucent light housing 216, which is preferably a water tight, corrosion proof enclosure, further including interface cable 226, a plurality of color illuminating elements of different colors (see e.g., FIG. 4), which are viewable from various starting positions including both starting and staging positions. An advantage of the housing 216 is that the activated lights are indeed viewable about the perimeter, from all radial angles (360 degrees) about the housing and thereby eliminates blind spots that may prevent an athlete from seeing the visual cues provided by the lights within the housing. Also referring to FIG. 4, housing 216 is generally tubular in shape. The housing includes an attachment component such as a rod 252 coupling the housing, via a coupling 264, to the support base 216, and a plurality of signaling elements are operatively distributed within the translucent housing. In one embodiment, ⅜" aluminum rod may be used, and the attachment components such as block 250 and coupling 264 would include connection holes sized to receive the ⅜" rod, and also a set screw, thumb screw or similar mechanism to hold the rod within the block. The ends of the translucent tube are covered or sealed with a conventional cap or plug 266 to minimize exposure to water, dirt, etc.

Figure 3:
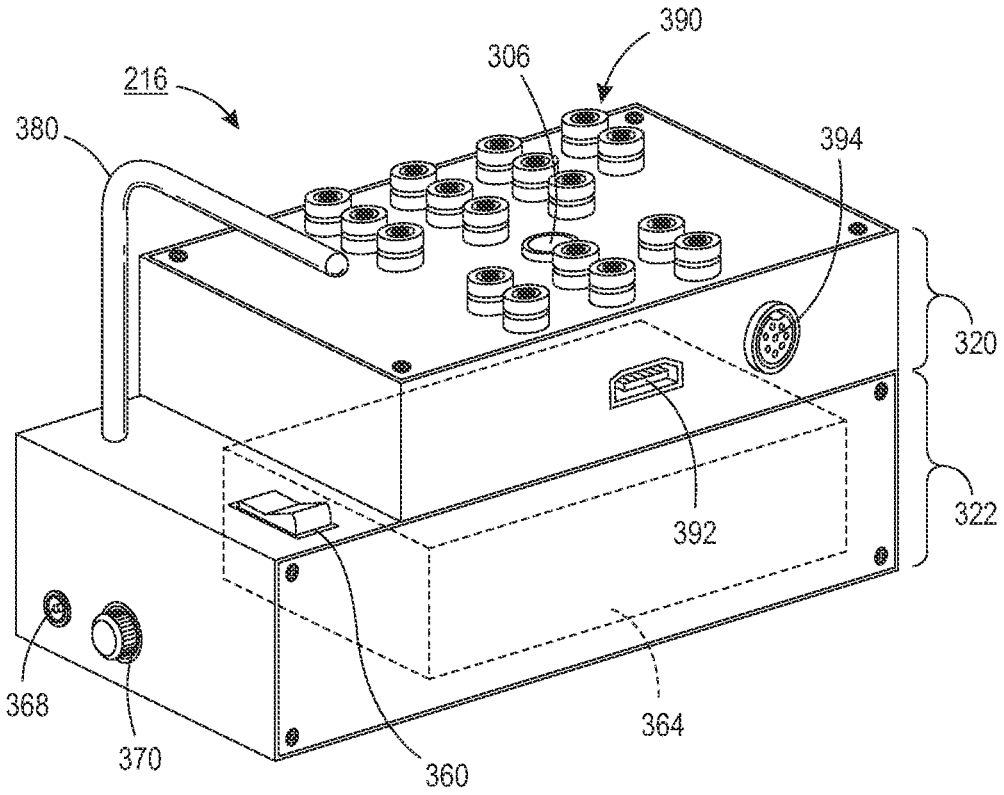
FIG. 3 is an illustration of a base of the signaling device for use in a self-supporting embodiment.
Figure 6:
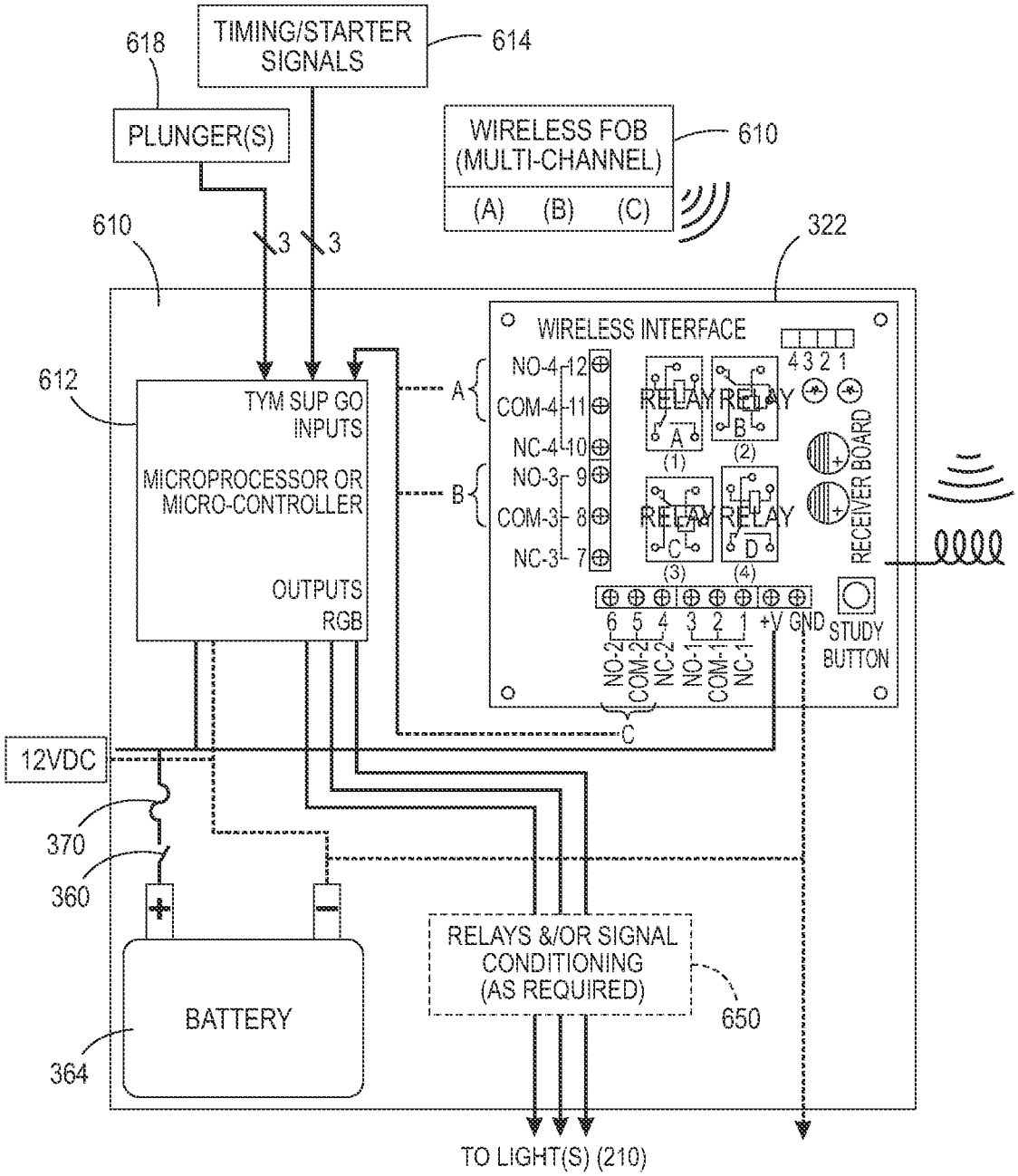
FIG. 6 is a block diagram illustrating circuitry and various components of a 9-12 volt embodiment of the signaling device.

As noted relative to the embodiments disclosed above, and as further described relative to FIG. 6, the system may also include control circuitry within the support base or housing 216. The base 216 includes two "levels". A top level 320 includes the connections and circuitry, while a lower level 322 includes a removable and rechargeable battery 364. The battery further provides mass in the base to assure stability when a light housing is attached. The control circuitry controls the color selection and on/off state (or flashing pattern) for the signaling elements. As seen in FIG. 3, an LED illuminated toggle switch 360 is available at one end of the support base 216, and not only controls the availability of the system and signaling lights, but itself provides a visual indication of the system being "on" and having battery or other source of power. The battery 364, a Lithium-based 12V battery that may or may not be rechargeable, provides adequate power to not only supply the control circuitry but to also power the signaling LEDs in response to a wired or wireless signal received by the system. The signaling apparatus includes or requires a source of power such as provided by battery 364, or via a deck plate connection or other source such as 12V connection 368, and an associated fuse 370. Base 216 also includes an attachment arm such as an L-shaped rod or handle 380, whereby the attachment block 250 can be adjustably attached to the unattached (horizontal) end of the rod 380. In this way the base, via rod 380, can provide support for rod 252 and associated light housing 210. In another embodiment, an additional switch 306 may be used to select the mode of operation of the controller—either linked to a timing system or responsive to manual signals (e.g., for training/testing). Lastly, base 216 itself may be formed from two conventional boxes that are modified with the required penetrations and attached to one another, or from a custom-molded unit with upper and lower enclosures to separate the battery from the electrical circuitry and components.

The control signals may be received via a cable that is either connected to the banana-type jacks 390 on the top of the base, or via one or more of the plurality of pin-type connectors 392 (e.g., a 5-pin connector from wireless receiver) or 394 (e.g., 8-pin connector from adjacent signaling device or deck plate) on the top portion of the support base. It will be appreciated that the wired connection may be facilitated by a deck plate 120 that includes not only timing signal connections, but also connections for power (12V), speakers and the like.

Referring also to FIG. 4 and FIGS. 5A-5C, the translucent light housing 210 includes a cylindrical translucent tube 216. A tape or ribbon 452 of multiple-colored light-emitting diodes (LEDs) is spirally wrapped about a cylindrical core 454 and the wrapped core is inserted within the translucent outer tube 216 after electrical connections are made to cable 226. The tube has caps or plugs 266 applied to the ends thereof to hold the LEDs inside and to prevent the LEDS from environmental exposure (e.g., being splashed, etc.). Depending upon the configuration, one of the plugs may include a hole or aperture to allow cable 226 to pass through, and where the cable is connected to the electronic circuitry in the housing and provides power/signals to the LED tape in order to control the on/off state of the LEDs as well as the color produced.

Figure 5A:
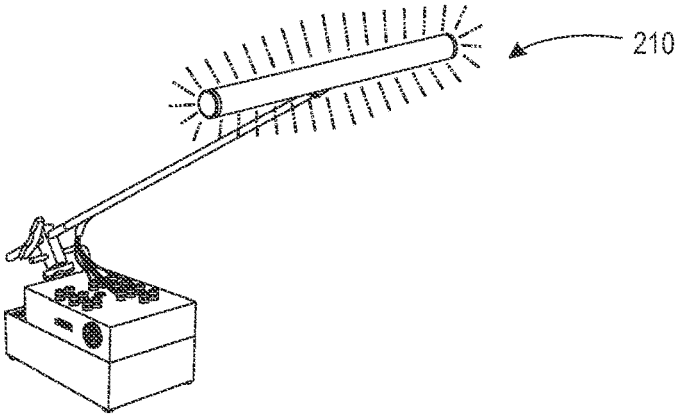
FIGS. 5A-5C are illustrations of the different operating ("on") modes of the translucent light housing.
Figure 5B:
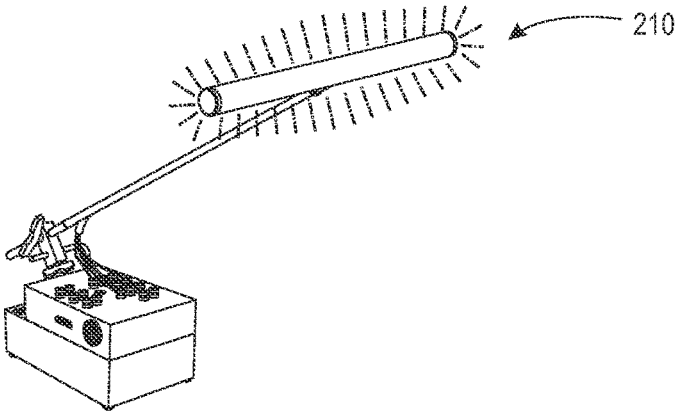
Figure 5C:
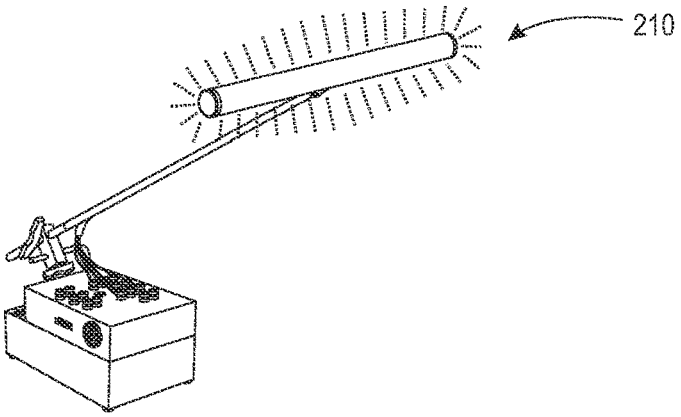

In operation, the LEDs are independent controllable by color, and the red, blue or green LEDs may be illuminated independently or concurrently. As illustrated in FIGS. 5A-5C, respectively, the three independent lighting modes are illustrated with the red, blue and green lights, respectively, showing within the translucent housings 210. Moreover, the lights may be displayed in a continuous-on manner or may be flashed in one or more patterns to signify different steps or commands to the athletes. It is also possible, as will be appreciated, to alter the LED display configuration to not only concurrently display two or more colors of LEDs, but also to intermix the flashing of such LEDs to thereby produce numerous distinct signals in the event that more than three are needed.

In the illustrated embodiments, the approximately 18-inch long light tube 210 is about 1-inch in diameter and is frosted so as to appear translucent. In the illustrated embodiment the tube 216 can attach via the supporting structure to the base, or alternatively, the tube may be directly connected to a deck plate or other wired system to provide the appropriate power signals to drive the lights. For example, the signaling device 202 may be configured as a single unit under a block for training, or also to an on-deck cable or wired deck plate 120 that handles as many lanes as needed. As will be appreciated, the signaling device illustrated is intended to run the lights in conjunction with providing other timing connections. And in another embodiment or configuration, a plurality of light tubes and/or signaling systems may be run off a separate 12V control unit that can be operated manually, with a wireless fob, or plunger push button(s) (see FIG. 6), and in all cases the starting device trips the green light at the same time the timer is started.

As an alternative to a deck plate or harness, for a wired system, a wireless system can be implemented to control the state of the illuminating elements within the signaling device by the use of either a radio, IR or other frequency, to activate the appropriate lights. Referring to FIG. 6, for example, using a conventional radio-frequency transmitter (e.g., 315-433 MHz) such as found in a fob available from various sources, the operation of the lights may be controlled by pressing separate buttons (e.g., A, B or C) on the fob. The receiver (322), connected to or embedded within the controller 610, receives the signal and makes the connection to provide power from battery 364 and thereby light the corresponding light. A simple schematic for the wireless receiver is illustrated in FIG. 6. As will be appreciated, the optional relays, which may be operatively included within the microprocessor or as separate components 650, operate to induce a power connection to the LED light circuits in ribbon 452 in response to the received signals from the fob buttons or from plunger(s) 618 or the timing/starting system 614. With regard to the wireless inputs, also contemplated is the use of Bluetooth, IEEE 802.15.1 at 2.4 GHz transmitters and receivers, which typically have a range of 30-40 feet.

In a wireless embodiment, the signaling device associated with each swim platform 100 could be connected to and synchronized to a common controller which would then transmit common signals (e.g., battery power) to each of the housings 216 to signal the athletes of the beginning of a race. It is further anticipated that other display devices, for example an alphanumeric display matrix, could be implemented within each swim platform to encode and display commands for the hearing impaired and or for spectators.

With regard to the timing starter signals from system 614, any suitable system providing a low voltage current via suitable switches may be used as an input to circuitry 610, as an input to a microcontroller or equivalent component 612, for controlling illumination of the starting sequence lights. One such system is an Infinity Speed Light system. The starting system switches may be activated manually or in the alternative a timer could be used to automatically sequence the lights (see e.g., FIG. 7), possibly in a random cadence to mitigate false starts due to the potential for the anticipation of the start light. The controller may also be interfaced with a race timer as well as a sounding device (e.g., horn, buzzer, etc.) to coincide with the start light. In an alternative embodiment, the controller may also include a transceiver for bilateral communications with each of the swim platforms, also having a transceiver therein, for the purpose of transmitting race start and stop events, as well as false starts. As described above, the platform receiver selectively causes power to be supplied to the lights when a trigger signal is received from the transmitter of the controller. Additionally, false starts and standings may be relayed back to the event referee by a wire, or may communicated wirelessly.

Also contemplated in one embodiment of the signaling system is a configuration where the receiver is either connected to or located in housing 216 (not separately connected) and is operatively connected to the control circuitry of FIG. 6 as illustrated to produce a desired visual signal in response to a user depressing one or more buttons on a wireless transmitter fob 610.

The signaling apparatus is well suited for swimming events where, in the past, a sound and arm motion comprised a start signal which has been problematic for athletes in general, but especially inequitable for the hearing impaired. Accordingly a plurality of signaling devices, preferably one attached to each swim platform, are engaged to stage and start a swimming competition by energizing a sequence of at least three lights. In order to discriminate the significance of each signaling operation, a distinct color and/or pattern is assigned to each, as depicted and described relative to the flowchart of FIG. 7.

Several of the enclosures or housings described herein may be made from conventional enclosures with modifications to enable the addition of various connections for power, signals and the like. In one embodiment the housings, such as those available from Philmore (e.g., ABS Enclosures No. PB404, PB411 and PB413), are waterproof, meet NEMA 4 specifications and would provide suitable enclosures.

Figure 7:
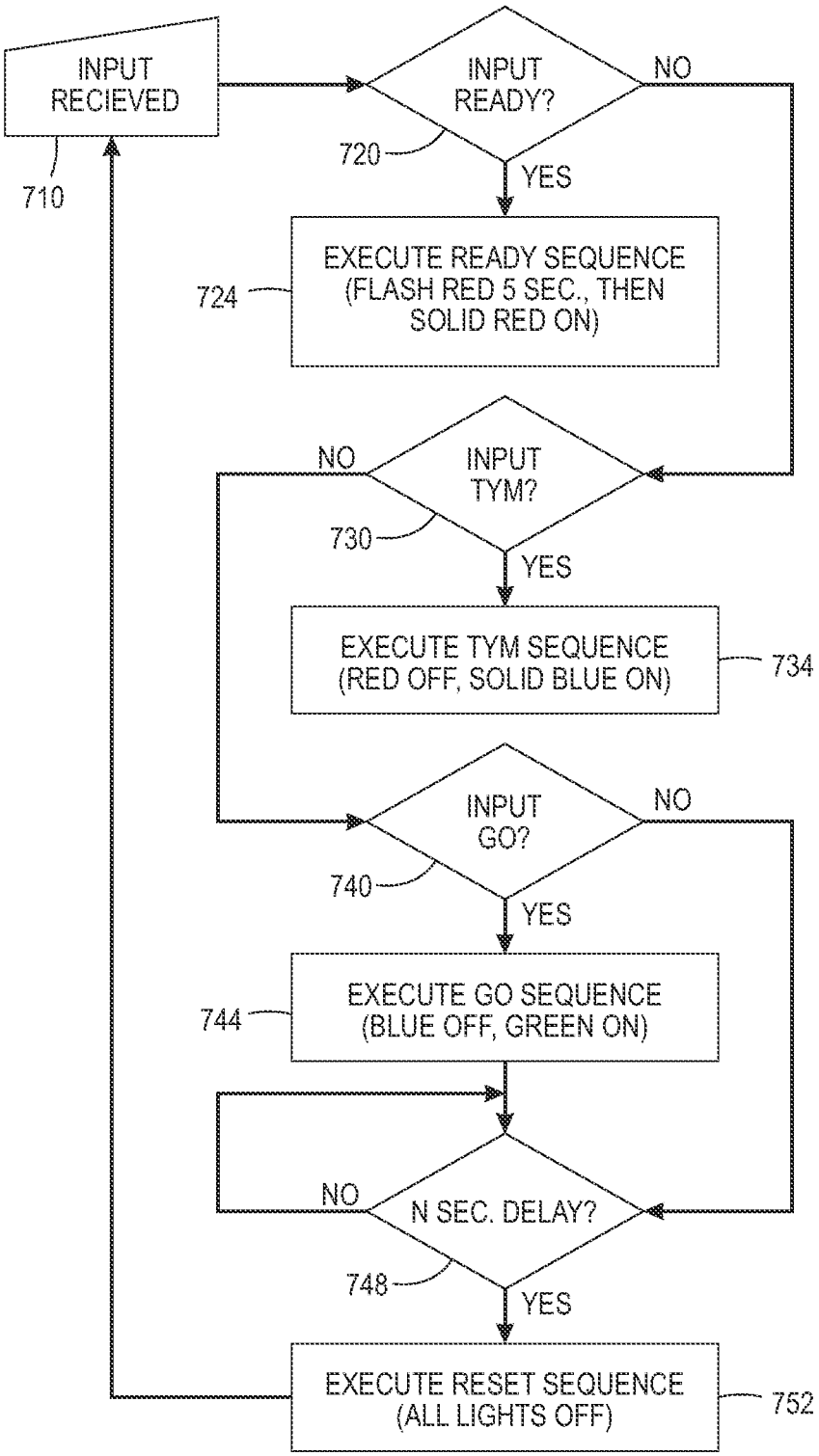
FIG. 7 is an illustration of the operations carried out by the signaling device system in an exemplary embodiment.

Having referred to the various components of the system, attention is now turned to the typical operation of the system, and a description is included relative to FIG. 7. As described herein, an input is received by the microprocessor at 710 and is interrogated. First, the red LEDs are used to tell the swimmer to get up on the block or to get into the water. These lights are controlled MANUALLY in response to a button plunger or wireless fob in a hand of the referee. In the illustrated embodiment, the microprocessor, in response to the "READY" input via a plunger, wireless fob, etc., is detected at step 720, and then operation 724 is executed by first flashing the red LEDs on and off for approximately 5-seconds and then putting the red LEDs into a continuous on state.

Next, as detected by step 730, the Take Your Mark (TYM) input initiates the blue LED lights (step 734) used to tell the swimmers take a racing position. These lights are also likely to be controlled MANUALLY by a button plunger or wireless fob in the hand of the starting official who then is "CONTROLLING" the time limit of the lights being on or off.

Lastly, at steps 740 and 744, green lights are used to tell the swimmers to "GO". These lights may be controlled automatically by the starting official when pushing the start button function on the start system and timing system. In one embodiment, in response to the official pressing or triggering the start of the timing system, the same signal is received by the microprocessor and in response to the signal the green or GO light is turned on. It will be further appreciated that for practice sessions, the fob has an adequate number of buttons so as to be employed to produce signals for all three (TYM, SUP and GO) lights as well as possible additional colors and/or patterns. Once the green light has been illuminated, it is kept in an on state for a defined period "N" (e.g., approx. 3 seconds), and after that delay (748) the system is reset by operation 752 and readied for the next timing sequence and all lights are turned off.

As noted above, the disclosed signaling system may be employed in other athletic venues. As an illustrative example, reference is made to FIG. 8, where a track venue is illustrated (indoor or outdoor). In the example, one lane 810 of a track is illustrated. The lane includes a starting block 820 placed near the starting line 824 as in a conventional configuration for a "sprint" start where blocks are used. In the illustrated embodiment, an elongated translucent tube 216 (approx. 32 inches in length), is placed in the lane between the athlete's feet so as not to interfere with the start. In this configuration, the athlete has a clear view of the translucent light tube and can also adjust its placement, forward or backward, at a desired viewing location based upon whether the athlete employs a head down or head up starting stance. In the illustrated embodiment, the tube 216 may be electrically connected to the control system and source of power via a plug configuration that is either available in a modified starting block or is provided via a wiring harness or plug receptacle available in the track surface or rails about the inner edge of the track. And, in a stand-up start, one or more vertical tubes 216 may be placed along an edge of the track to be viewed by the athletes. In another alternative embodiment, the translucent tube(s) or a similar configuration may be placed on top of or embedded within a lane marking line 830.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims

What is claimed is:

1. An athletic competition signaling apparatus for the hearing impaired, comprising:

a translucent housing, said housing including an elongated translucent tube forming an outer shell of the housing and an adjustable attachment component, said attachment component adjustably coupling the housing to a stationary structure, and a plurality of light-emitting elements operatively enclosed within said elongated translucent tube, the light-emitting elements producing one of at least three distinct visual outputs, said translucent housing positioned, using said adjustable attachment component, such that each of the distinct visual outputs is viewable from a plurality of positions about the translucent housing, whether prior to or upon initiating the athletic competition, including at least a starting position and a staging position different than the starting position.

2. The signaling apparatus according to claim 1, further including a remote control circuit to independently energize each of the signaling elements.

3. The signaling apparatus according to claim 2, wherein a plurality of similarly configured housings are employed for a plurality of staging and starting positions in a competition.

4. The signaling apparatus according to claim 3, wherein the athletes are swimmers and the light-emitting elements produce a visual output viewable from a plurality of starting positions, and where the plurality of housings are operatively associated with separate swim starting blocks, each at an end of a lane, and are employed to stage and start a swimming competition.

5. The signaling apparatus according to claim 1 wherein each signaling element emits light of a distinct color.

6. The signaling apparatus according to claim 1 wherein at least a portion of said translucent housing is viewable about the entire periphery of the housing to provide 360-degree visibility.

7. The signaling apparatus according to claim 1 wherein each of the signaling elements designates one operation in staging and starting of an athletic competition.

8. The athletic competition signaling apparatus according to claim 7, wherein the system is linked to a timing system and where the signaling elements associated with starting the athletic competition are activated at the same time the timing system starts.

9. An athletic competition signaling apparatus, comprising:

an elongated tubular translucent housing, said housing including an attachment component coupling the housing to an adjustable support structure, and a plurality of signaling elements spirally wrapped about a core and operatively inserted within said elongated tubular housing, wherein the signaling elements each produce a distinguishable visual output viewable from a plurality of positions including at least a starting position and a staging position, different from the starting position; and control circuitry, associated with the signaling elements, said circuitry controlling the color and on/off state for the signaling elements.

10. The signaling apparatus according to claim 9 further including a source of power.

11. The signaling apparatus according to claim 9 wherein said support structure includes a base with a battery that rests on a generally horizontal surface, and includes circuitry for receiving signals to control the signaling elements.

12. The signaling apparatus according to claim 9 wherein said signaling elements include a ribbon of light-emitting diodes wrapped about a cylindrical core and inserted within a translucent outer tube, said tube including caps applied to the ends thereof to hold the light-emitting diodes inside and to isolate the light-emitting diodes from environmental exposure.

13. The signaling apparatus according to claim 9 further including a wireless transmitter and receiver, the receiver being operatively connected to the signaling elements so as to produce a desired visual signal in response to a user depressing one or more buttons on the wireless transmitter.

14. A system for signaling a plurality of commands for initiating a swimming competition completed in a swimming pool having lanes and at an end of each of the lanes a starting platform, said system including multiple signaling apparatus, at least one for each lane, each signaling apparatus comprising:

a base adjacent a starting platform at the end of each lane of the swimming pool, said base including an attachment arm extending from said base;

a rod, adjustably attached to said attachment arm;

an elongated translucent light housing, positioned by adjustment of at least said base, attachment arm and rod to be viewable by at least one competitor from at least a staging position and a starting position, said light housing including a linear tape with a plurality of light emitting diodes of at least two different and individually activated colors sequentially spaced along the linear tape, said linear tape spirally wrapped about a core, and said spirally wrapped linear tape inserted within a translucent hollow tube so that each of the different and individually activated colors are seen from all radial angles viewable about a perimeter of the translucent hollow tube, said tube also including at least one end cap on an end thereof, and an attachment component operatively connecting the light housing and the rod; and control circuitry, operatively connected to said battery and the signaling elements, said circuitry controlling, in response to a plurality of external signals, the on/off state for the signaling elements;

wherein the light emitting diodes produce a plurality of visual outputs, each of said outputs being viewable from all radial angles about the perimeter of the light housing, to be seen from a lane for which the apparatus is employed as well as at least an adjacent lane.

15. The system according to claim 14, wherein said control circuitry for each signaling apparatus includes a microprocessor for controlling the on/off state of the light-emitting diodes so as to produce a predefined sequence of states.

16. The system according to claim 14 wherein the system is linked to a timing system that provides at least one external signal and where the signaling elements associated with starting the athletic competition are activated at the same time the timing system starts.

17. The system according to claim 16 wherein each of said multiple signaling apparatus is suitable for simultaneously emitting:

(i) a first color flashing light in response to a first signal;

(ii) a second color solid light in response to a second signal; and (iii) a third color solid light in response to the external signal produced by the timing system.

18. The system according to claim 17 wherein the first color light is red, the second color light is blue and the third color light is green.

19. The system according to claim 14 wherein the system receives external signals from a plurality of external devices, including a timing system that provides at least one signal associated with starting the athletic competition such that the system is suitable for initiating visual outputs including at least:

(i) a first color flashing light in response to a first external signal;

(ii) a second color solid light in response to at least one external signal associated with starting the athletic competition; and (iii) at least a third color light in response to a second external signal.

20. The system according to claim 19 wherein the plurality of visual outputs further includes maintaining, in response to one of said external signals, an associated emitted light and on/off state for a predefined period of time.

* * * * *